US011778382B2

(12) United States Patent
Feng et al.

(10) Patent No.: US 11,778,382 B2
(45) Date of Patent: Oct. 3, 2023

(54) AUDIO SIGNAL PROCESSING APPARATUS AND METHOD

(71) Applicant: Alibaba Group Holding Limited, Grand Cayman (KY)

(72) Inventors: Jinwei Feng, Bellevue, WA (US); Xinguo Li, Beijing (CN); Yang Yang, Hangzhou (CN)

(73) Assignee: Alibaba Group Holding Limited

( * ) Notice: Subject to any disclaimer, the term of this patent is extended or adjusted under 35 U.S.C. 154(b) by 0 days.

(21) Appl. No.: 17/143,787

(22) Filed: Jan. 7, 2021

(65) Prior Publication Data

US 2021/0127208 A1 Apr. 29, 2021

Related U.S. Application Data

(63) Continuation of application No. PCT/CN2018/100464, filed on Aug. 14, 2018.

(51) Int. Cl.

| | |
|---|---|
| ***H04R 5/027*** | (2006.01) |
| ***H04R 1/02*** | (2006.01) |
| ***H04R 5/04*** | (2006.01) |

(52) U.S. Cl.

CPC ..... *H04R 5/027* (2013.01); *H04R 1/02* (2013.01); *H04R 5/04* (2013.01)

(58) Field of Classification Search

CPC . H04R 5/027; H04R 5/04; H04R 1/02; H04R 1/08; H04R 1/32; H04R 1/326; H04R 1/406; H04R 3/005; H04R 2201/401; H04R 2201/403

See application file for complete search history.

(56) References Cited

U.S. PATENT DOCUMENTS

| | | | |
|---|---|---|---|
| 6,584,203 | B2 | 6/2003 | Elko et al. |
| 7,158,645 | B2 | 1/2007 | June et al. |
| 7,515,721 | B2 | 4/2009 | Tashev et al. |
| 7,630,502 | B2 | 12/2009 | Beaucoup et al. |
| 8,090,117 | B2 | 1/2012 | Cox |
| 8,903,106 | B2 | 12/2014 | Meyer et al. |
| 9,326,064 | B2 | 4/2016 | Duraiswami et al. |
| 9,445,198 | B2 | 9/2016 | Elko et al. |
| 9,503,818 | B2 | 11/2016 | Kordon et al. |
| 9,734,822 | B1 * | 8/2017 | Sundaram ..... G10L 15/08 |
| 9,961,437 | B2 | 5/2018 | McLaughlin et al. |

(Continued)

FOREIGN PATENT DOCUMENTS

| | | |
|---|---|---|
| CN | 102227918 A | 10/2011 |
| CN | 203608356 U | 5/2014 |

(Continued)

OTHER PUBLICATIONS

English translation of Internation Search Report dated May 15, 2019, from corresponding PCT Application No. PCT/CN2018/100464, 2 pages.

(Continued)

*Primary Examiner* — Jason R Kurr

(74) *Attorney, Agent, or Firm* — Lee & Hayes, P.C.

(57) ABSTRACT

An audio signal processing apparatus is provided by the present disclosure, and includes: multiple microphones; and every two of the multiple microphones being arranged in close proximity to each other, and the multiple microphones forming a symmetrical structure.

20 Claims, 9 Drawing Sheets

(56) References Cited

U.S. PATENT DOCUMENTS

| | | | | |
|---|---|---|---|---|
| 9,973,849 | B1 * | 5/2018 | Zhang | H04R 3/005 |
| 10,117,019 | B2 * | 10/2018 | Elko | G10L 21/0264 |
| 10,304,475 | B1 * | 5/2019 | Wang | G10L 15/16 |
| 2009/0175466 | A1 * | 7/2009 | Elko | G10L 21/0216 381/94.1 |
| 2010/0142732 | A1 * | 6/2010 | Craven | H04S 3/00 381/170 |
| 2015/0213811 | A1 * | 7/2015 | Elko | H04R 3/005 381/92 |
| 2016/0173978 | A1 * | 6/2016 | Li | G10L 21/0364 381/92 |
| 2018/0227665 | A1 * | 8/2018 | Elko | H04R 3/005 |
| 2019/0058944 | A1 * | 2/2019 | Gunawan | H04R 3/005 |
| 2019/0104371 | A1 * | 4/2019 | Ballande | H04R 25/554 |
| 2019/0246203 | A1 * | 8/2019 | Elko | H04R 1/406 |
| 2019/0273988 | A1 * | 9/2019 | Christoph | H04R 3/005 |

FOREIGN PATENT DOCUMENTS

| | | | |
|---|---|---|---|
| CN | 105764011 | A | 7/2016 |
| CN | 106842131 | A | 6/2017 |

OTHER PUBLICATIONS

English translation of Written Opinion dated May 15, 2019, from corresponding PCT Application No. PCT/CN2018/100464, 3 pages.

* cited by examiner

AUDIO SIGNAL PROCESSING APPARATUS AND METHOD

CROSS REFERENCE TO RELATED PATENT APPLICATIONS

This application claims priority to and is a continuation of PCT Patent Application No. PCT/CN2018/100464 filed on 14 Aug. 2018, and entitled "Audio Signal Processing Apparatus and Method," which is hereby incorporated by reference in its entirety.

TECHNICAL FIELD

The present disclosure relates to audio signal processing apparatuses and corresponding methods.

BACKGROUND

In order to obtain high-quality sound signals, microphone arrays are widely used in a variety of different front-end devices, such as automatic speech recognition (ASR) and audio/video conference systems. Generally speaking, picking up the "best quality" sound signal means that the obtained signal has the largest signal-to-noise ratio (SNR) and the smallest reverberation.

In an audio pickup system of an existing conference system, a common "octopus" structure 100 as shown in FIG. 1 is generally used, i.e., three directional microphones 102 that form an included angle of 120 degrees with each other are set at three "ends". A sound signal passing through these three ends is received by one of the microphones, and then the received sound signal is processed using a digital signal processing apparatus. However, in this type of design, if a direction of a sound signal is not consistent with an end that includes a directional microphone, the sound signal will experience a relatively severe attenuation during a receiving process. Generally speaking, this type of problem is called "off-axis". For example, if a sound signal comes from a direction of an angular bisector (60 degree direction) of two ends, such as the A direction as shown in FIG. 1, the sound signal that is obtained is then attenuated to 3 dB in such direction, as shown by an attenuation curve of FIG. 1-1. In this case, if a speaker is located in the A direction in FIG. 1, his voice signal will be greatly attenuated during a pickup process, thereby possibly making a person at the other end of the conference (which may be located in another city) failing to hear his words clearly. On the other hand, during the conference, noise signals other than that of the speaker often appear. In special circumstances, for example, noises (such as making a phone call) made by other participants located in directions different from that of the speaker, and if the speaker is located in the A direction in FIG. 1, noise happens to come from the B direction in FIG. 1 (the end direction of one of the microphones), then the sound signal of the speaker will be suppressed during the pickup process, and the noise signal will be completely picked up without attenuation. As a result, the person at the other end of the conference will not be able to obtain effective information.

In another design scheme 200, as shown in FIG. 2, three omnidirectional microphones 202 are used to form a ring structure, and the spacing 204 between the omnidirectional microphones is about 2 cm. Although this design can partially solve the above attenuation problem caused by deviation of the sound signal from the axis, such type of design will amplify the low-frequency white noise, resulting in the so-called white-noise-gain (WNG) problem.

Accordingly, new audio signal processing apparatuses and methods are needed to solve the above technical problems.

SUMMARY

This Summary is provided to introduce a selection of concepts in a simplified form that are further described below in the Detailed Description. This Summary is not intended to identify all key features or essential features of the claimed subject matter, nor is it intended to be used alone as an aid in determining the scope of the claimed subject matter. The term "techniques," for instance, may refer to device(s), system(s), method(s) and/or processor-readable/computer-readable instructions as permitted by the context above and throughout the present disclosure.

According to the present disclosure, an audio signal processing apparatus is provided, and includes: multiple microphones; every two of the multiple microphones being arranged in close proximity to each other, and the multiple microphones forming a symmetrical structure.

In implementations, the multiple microphones are three.

In implementations, every two of projections of axes of the multiple microphones on a same horizontal plane form an included angle of 120 degrees.

In implementations, axes of the multiple microphones are located in a same horizontal plane, and axes of any two of the multiple microphones form an included angle of 120 degrees.

In implementations, the multiple microphones are three, and the multiple microphones constitute an overlaid pattern.

In implementations, every two of axes of the multiple microphones are parallel, and projection points of the axes in a vertical plane thereof form three vertices of an equilateral triangle.

In implementations, a distance between ends of any two microphones ranges from 0-5 mm.

In implementations, the microphones include directional microphones.

In implementations, the microphones include at least one of the following: a Cardioid microphone, a Subcardioid microphone, a Supercardioid microphone, a Hypercardioid microphone, and a Dipole microphone.

According to another aspect of the present disclosure, an audio signal processing method is provided, which uses an audio signal processing apparatus disclosed in the present disclosure, and includes steps of: linearly combining audio signals obtained by multiple microphones; and dynamically selecting a best pickup direction based on a combined audio signal.

In implementations, a matrix A used for a linear combination is set as:

$$A = \begin{bmatrix} 1+\cos(\theta_n) & 1+\cos(\theta_n - 2*\pi/3) & 1+\cos(\theta_n + 2*\pi/3) \\ \sin(\theta_m) & \sin(\theta_m - 2*\pi/3) & \sin(\theta_m + 2*\pi/3) \\ (1+\cos(\theta_m))/2 & (1+\cos(\theta_m - 2*\pi/3))/2 & (1+\cos(\theta_m + 2*\pi/3))/2 \end{bmatrix}$$

where $\theta_m$ is a beam angle, and $\theta_n$ is a null angle.

In implementations, when the audio signals of the multiple microphones are combined in a virtual Hyper-cardioid microphone mode, $\theta_n=\theta_m+110*\pi/180$.

In implementations, when the audio signals of the multiple microphones are combined in a virtual Cardioid microphone mode, $\theta_n=\theta_m+\pi$.

In implementations, the combined audio signal is continuously processed based on a set sampling time interval to obtain audio signals in multiple virtual directions. The audio signals in multiple virtual directions are compared, and a direction with the highest signal-to-noise ratio is selected as the pickup direction.

In implementations, a short-time Fourier transform is used to process the combined audio signal.

In implementations, the set sampling time interval is 10-20 ms.

In implementations, an audio signal is obtained and output based on the selected pickup direction.

According to the present disclosure, a non-transitory storage medium is provided. The non-transitory storage medium stores an instruction set. The instruction set, when executed by a processor, causes the processor to be able to perform the following process: linearly combining audio signals obtained by multiple microphones; and dynamically selecting a best pickup direction based on a combined audio signal.

BRIEF DESCRIPTION OF THE DRAWINGS

Drawings described herein are used to provide a further understanding of the disclosure and constitute a part of the disclosure. Exemplary embodiments and descriptions of the disclosure are used to explain the disclosure, and do not constitute an improper limitation of the disclosure. In the accompanying drawings:

FIG. 1-1 shows a pickup attenuation curve of a conference system device in FIG. 1.

FIG. 2-1 is a schematic diagram of a conference system device in existing technologies.

DETAILED DESCRIPTION

The foregoing overview and the following detailed description of exemplary embodiments will be better understood when reading in conjunction with the drawings. In terms of simplified diagrams that illustrate functional blocks of the exemplary embodiments, the functional blocks do not necessarily indicate a division between hardware circuits. Therefore, one or more of the functional blocks (such as a processor or a memory) may be implemented in, for example, a single piece of hardware (such as a general-purpose signal processor or a piece of random access memory, a hard disk, etc.) or multiple pieces of hardware. Similarly, a program can be an independent program, can be combined into a routine in an operating system, or can be a function in an installed software package, etc. It should be understood that the exemplary embodiments are not limited to arrangements and tools as shown in the figures.

As used in the present disclosure, an elements or step described in a singular form or beginning with a word "a" or "an" need to be understood as not excluding the plural of the element or step, unless such exclusion is clearly stated. In addition, references to "an embodiment" are not intended to be interpreted as excluding an existence of additional embodiments that also incorporate features that are recited. Unless the contrary is clearly stated, embodiments that "include", "contain" or "have" element(s) having a particular attribute may include additional such elements that do not have that attribute.

Figure 3:
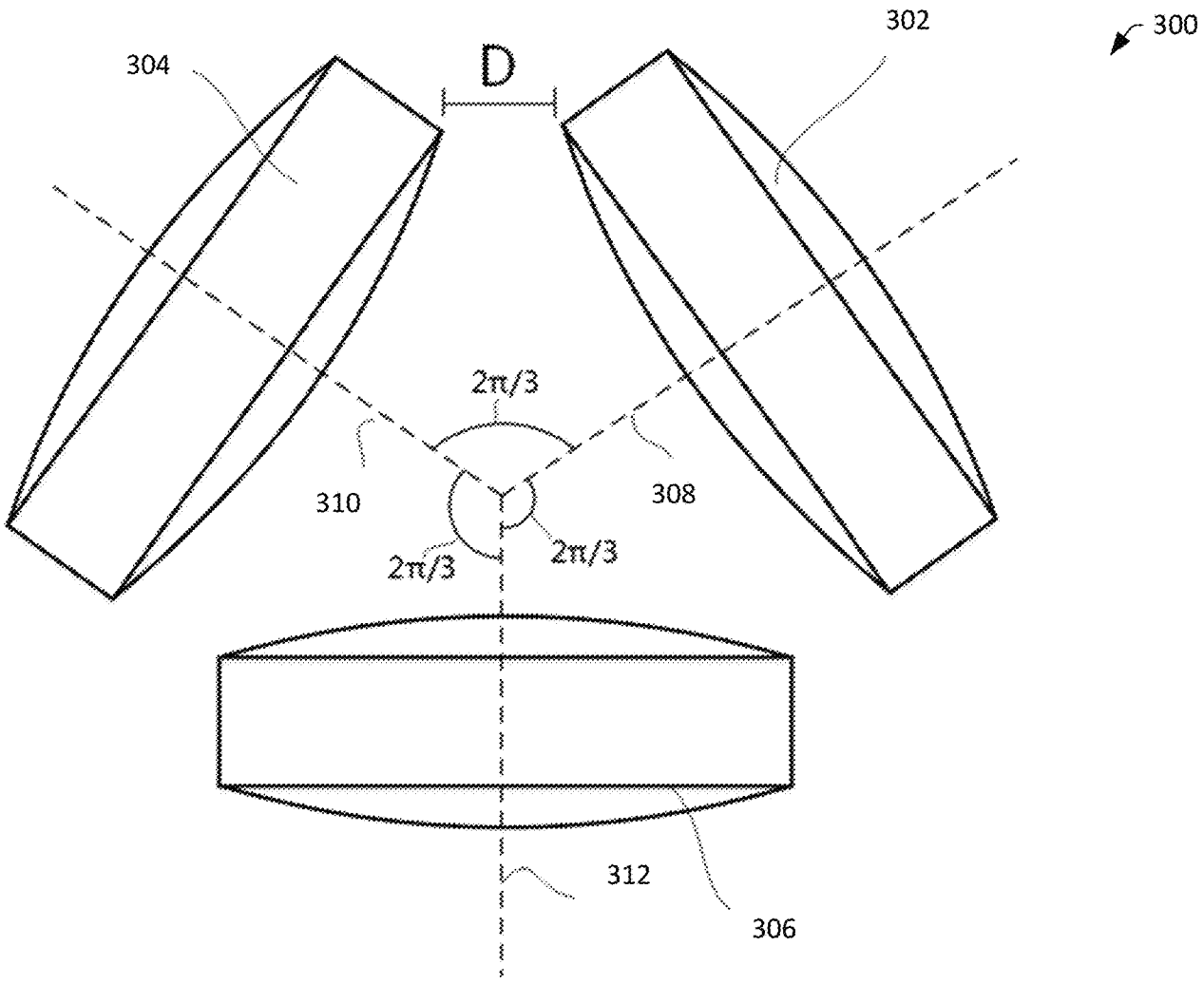
FIG. 3 is a schematic of a multi-microphone setting according to the present disclosure.

The present disclosure provides a microphone setting 300 of an audio signal processing apparatus as shown in FIG. 3. FIG. 3 shows three directional microphones 302, 304, and 306, which form a triple symmetrical arrangement as a whole. Axes 308, 310 and 312 (i.e., lines perpendicular to the center of a sound pickup plane) of the three directional microphones are located in a same plane, and form an included angle of $\pi 2/3$ in each pair thereof. And, a distance range D between ends of the directional microphones 302, 304, and 306 (such as between 302 and 304 as shown in the figure) is 0-5 mm. As a preference, D=2 mm can be selected.

Figure 4:
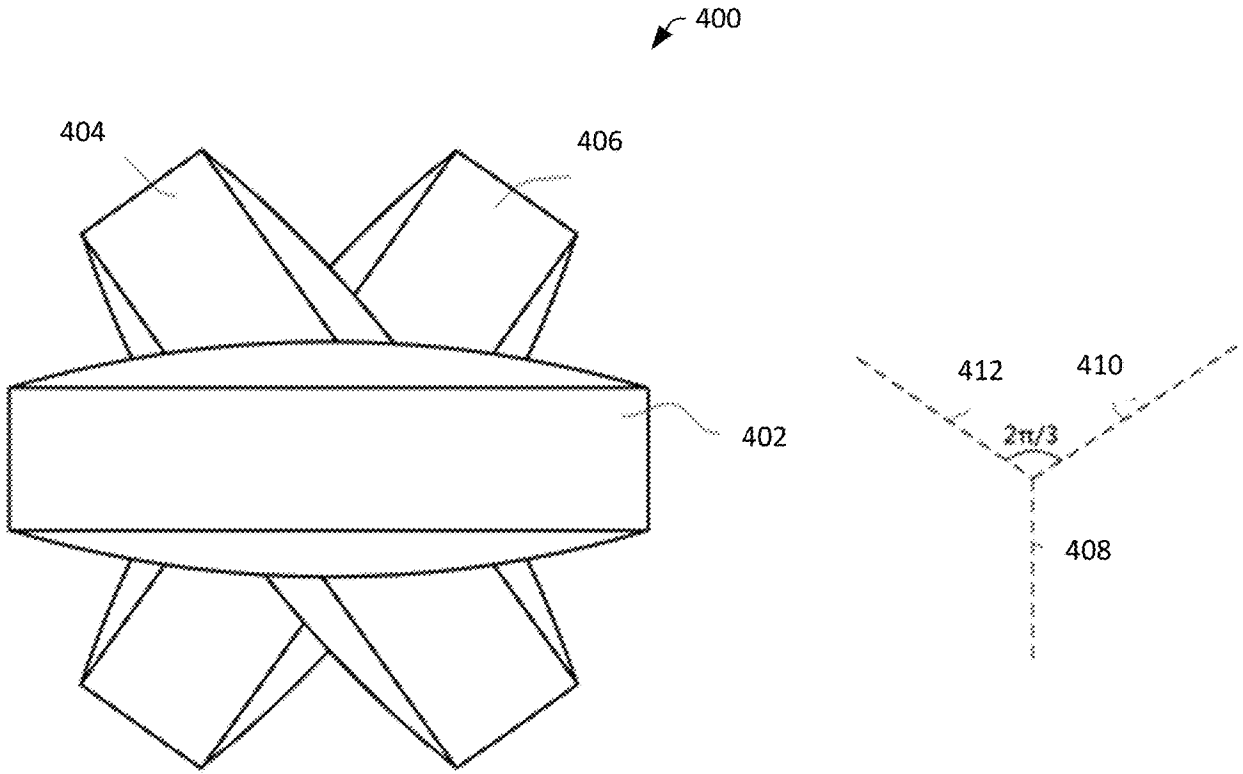
FIG. 4 is a schematic of a multi-microphone setting according to the present disclosure.

The present disclosure further provides a microphone setting 400 of an audio signal processing apparatus as shown in FIG. 4. FIG. 4 shows three overlaid directional microphones 402, 404 and 406. FIG. 4 shows a "top-down" perspective. The three directional microphones are 402, 404 and 406 from top to bottom. Axes of the directional microphones 402, 404 and 406 (lines perpendicular to the center of a sound pickup plane) are parallel to a plane of FIG. 4. If the directional microphones 402, 404 and 406 are projected onto the plane of FIG. 4, they also form a triple symmetrical arrangement. The axes 408, 410 and 412 of the three directional microphones form an included angle of $\pi 2/3$ in pairs (as shown by a dashed axis on the right side of FIG. 4) in the projection plane of FIG. 4.

Figure 5:
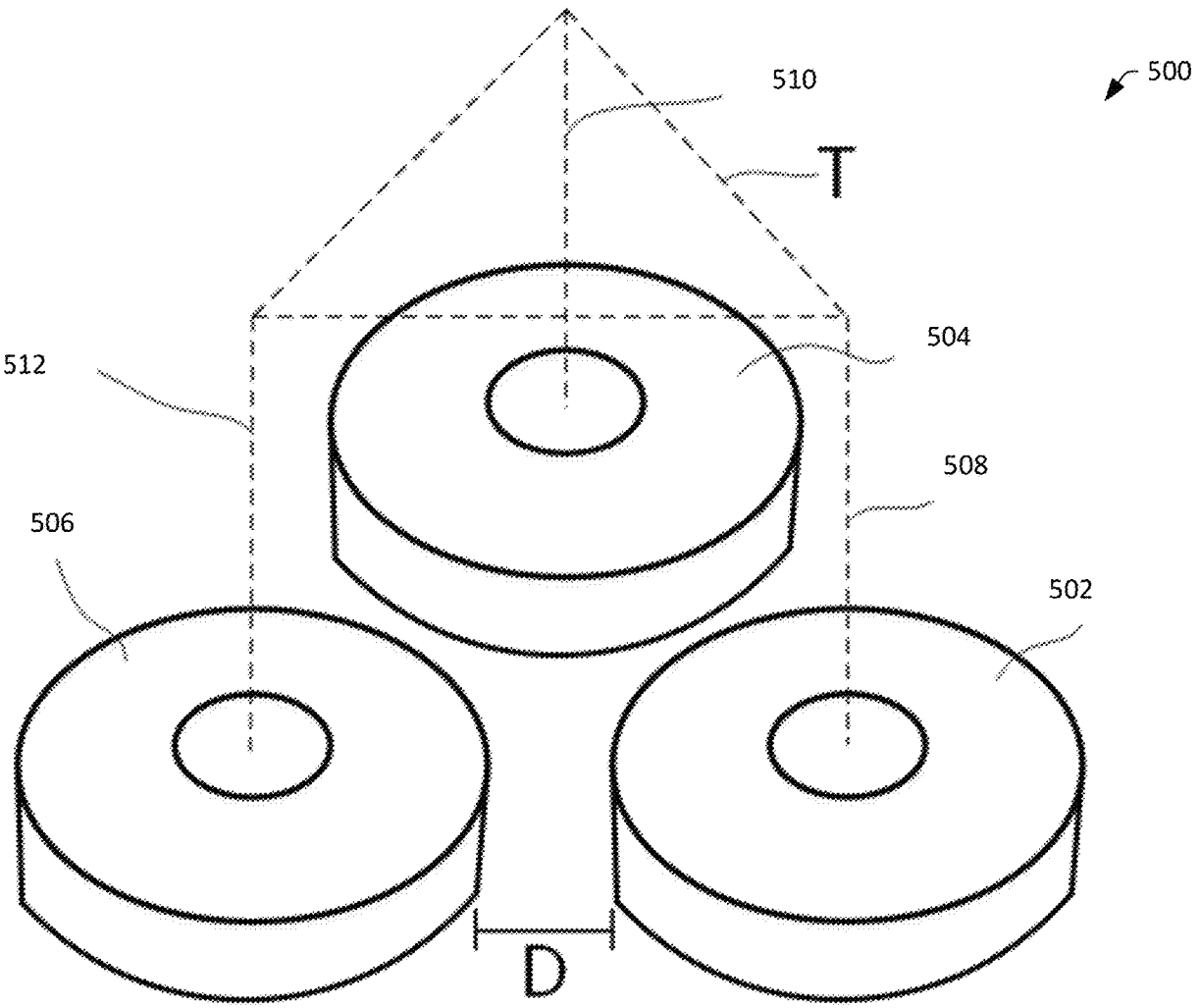
FIG. 5 is a schematic of a multi-microphone setting according to the present disclosure.

The present disclosure further provides a microphone setting 500 of an audio signal processing apparatus as shown in FIG. 5. FIG. 5 shows three directional microphones 502, 504 and 506. The three directional microphones form a triple symmetrical arrangement. Axes 508, 510 and 512 (lines perpendicular to the center of a sound pickup plane) of the three directional microphones are parallel to each other, and three projection points of the axes 508, 510 and 512 in a plane that is perpendicular to them constitute an equilateral Triangle T. Furthermore, a distance range D between ends of the directional microphones 502, 504 and 506 (such as between 502 and 504 as shown in the figure) is 0-5 mm. As a preference, D=2 mm can be selected.

In implementations, suitable directional microphones can be selected to form microphone settings shown in FIGS. 3-5. Directional microphones include, but are not limited to, Cardioid microphones, Subcardioid microphones, Supercardioid microphones, Hypercardioid microphones, Dipole microphone, to form the microphone settings shown in FIGS. 3-5. It is understandable that same directional microphones, such as cardioid microphones, can be selected to form any of the microphone settings in FIGS. 3-5. Alternatively, a combination of different types of directional microphones can be selected to form any of the microphone settings in FIGS. 3-5.

When the microphone settings shown in FIGS. 3-5 are used, the technical solutions of the present disclosure, in conjunction with an algorithm of the present disclosure to be described below, can achieve a lossless sound pickup effect in any direction, thereby solving the "off-axis" and "WNG" problems.

Unlike traditional solutions where a certain microphone picks up sound, the technical solutions of the present disclosure will simultaneously pick up and combine audio signals from multiple microphones. In the technical solutions of the present disclosure, distances between the multiple microphones are set to be as small as possible, which can thereby reduce time differences between audio signals that arrive at different microphones as much as possible, making it possible to "simultaneously" combine the audio signals of multiple microphones in a physical structure in the first place.

In the technology of the present disclosure, a "virtual microphone" is formed by "simultaneously" linearly combining three signals from physical microphones (for example, cardioid microphones). Coefficients of a linear combination are represented by a vector μ:

$$\mu = \mathrm{inv}(A) * b, \text{ where:}$$

$$A = \begin{bmatrix} 1+\cos(\theta_n) & 1+\cos(\theta_n - 2*\pi/3) & 1+\cos(\theta_n + 2*\pi/3) \\ \sin(\theta_m) & \sin(\theta_m - 2*\pi/3) & \sin(\theta_m + 2*\pi/3) \\ (1+\cos(\theta_m))/2 & (1+\cos(\theta_m - 2*\pi/3))/2 & (1+\cos(\theta_m + 2*\pi/3))/2 \end{bmatrix}$$

$$b = [0\ 0\ 1]^T$$

$\theta_m$ represents a beam angle (i.e., a direction of a desired audio signal), and $\theta_n$ represents a null angle (i.e., a direction of an undesired audio signal).

In implementations, if it is desired to linearly combine signals of three microphones to form a virtual hypercardioid microphone, a relationship between $\theta_m$ and $\theta_n$ is selected as:

$$\theta_n = \theta_m + 110*\pi/180$$

Figure 1:
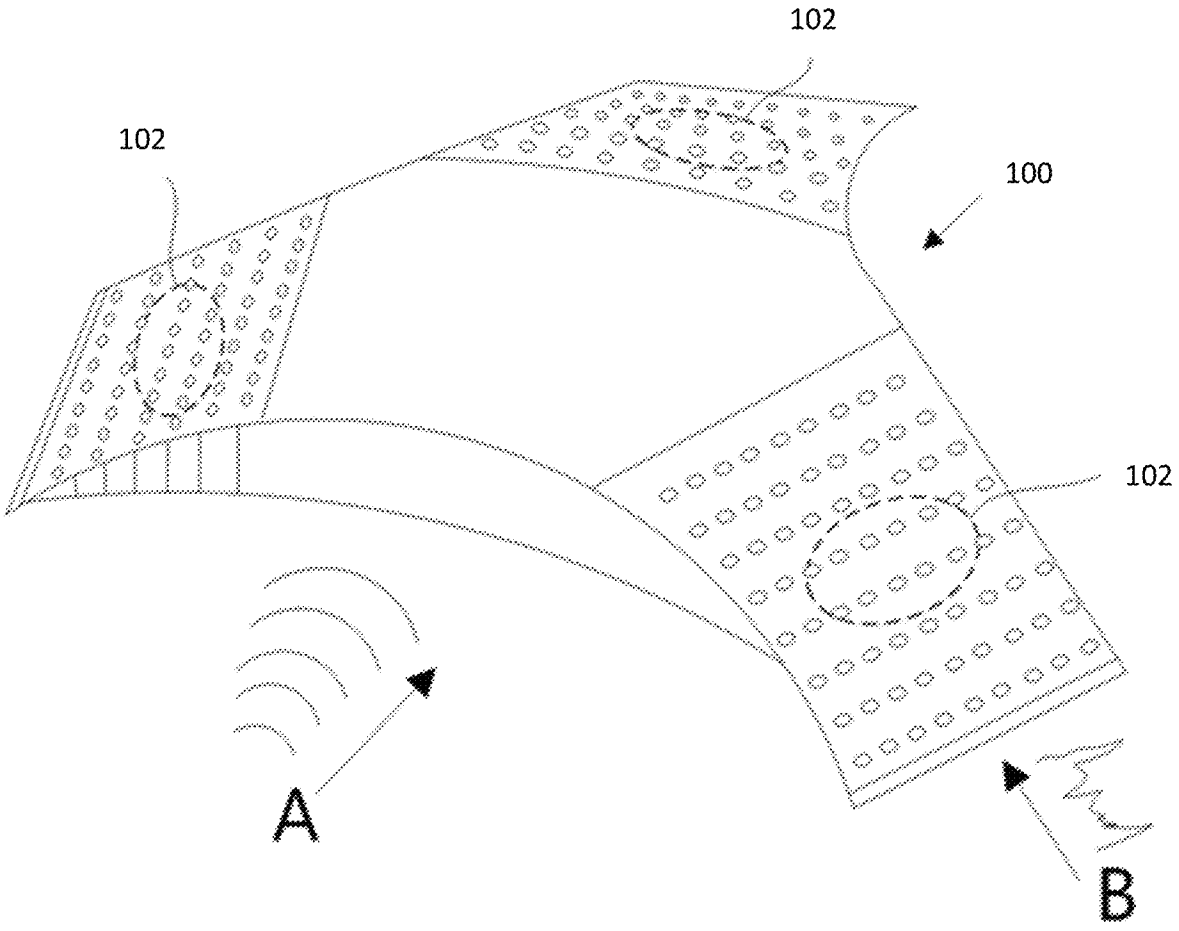
FIG. 1 (PRIOR ART)
FIG. 1 is a schematic diagram of a conference system device in existing technologies.
Figure 1:
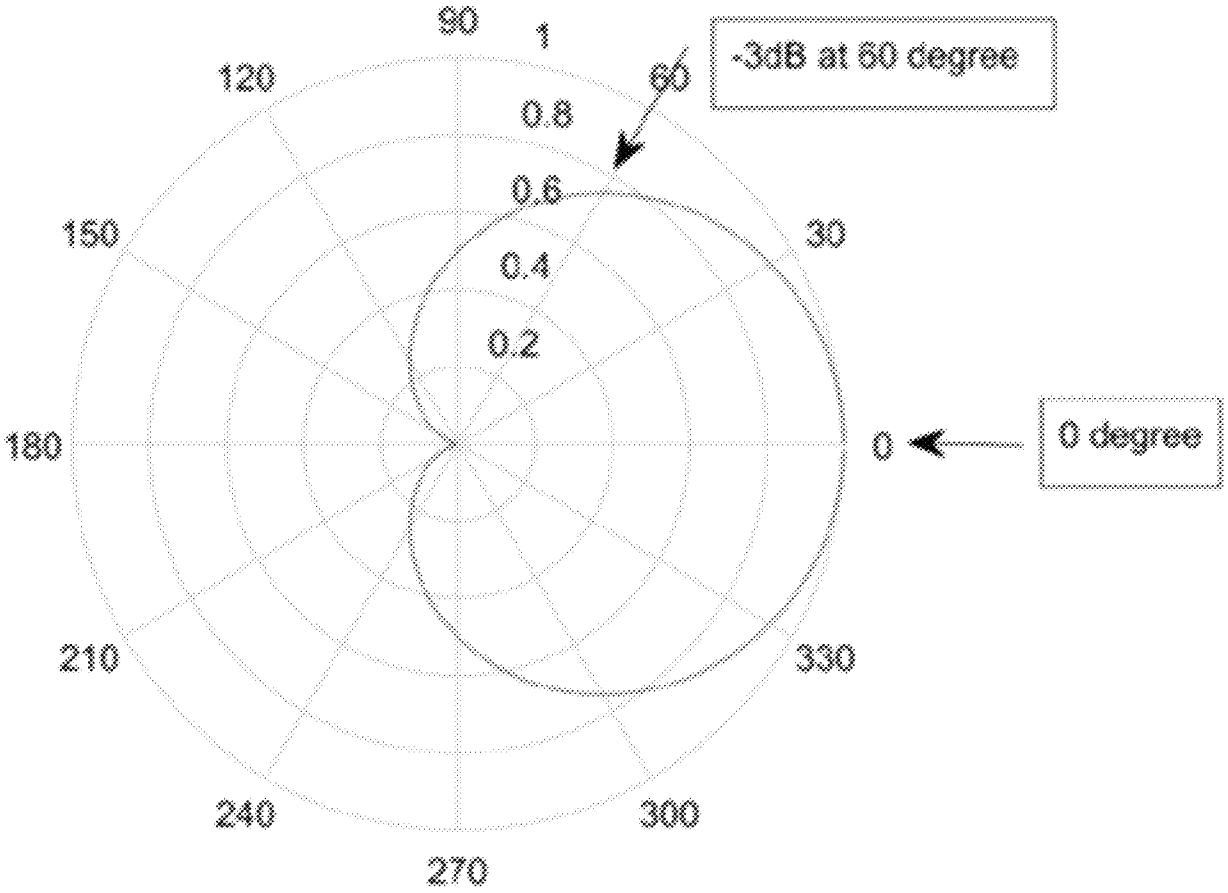
FIG. 1-1 (PRIOR ART)
Figures 1, 2:
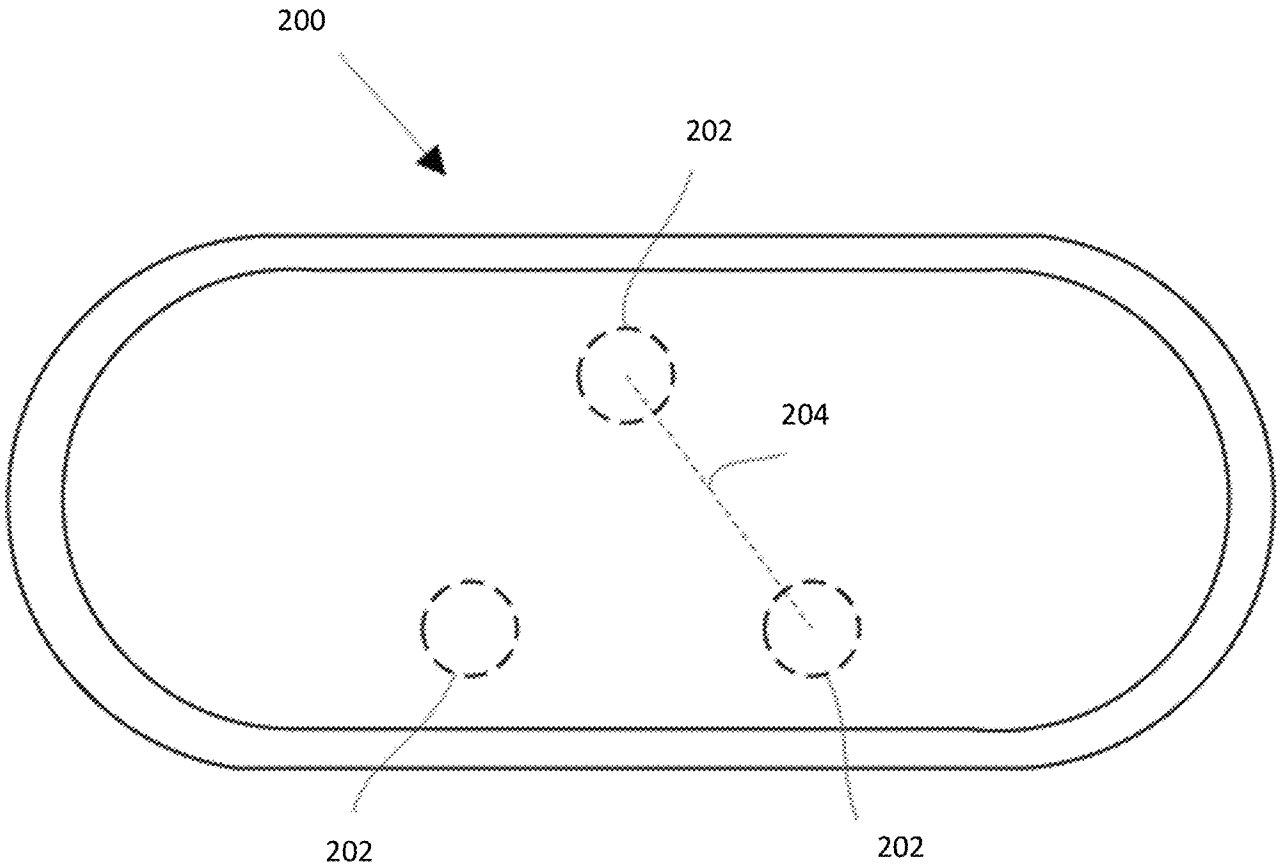
FIG. 2-1 (PRIOR ART)
Figure 6:
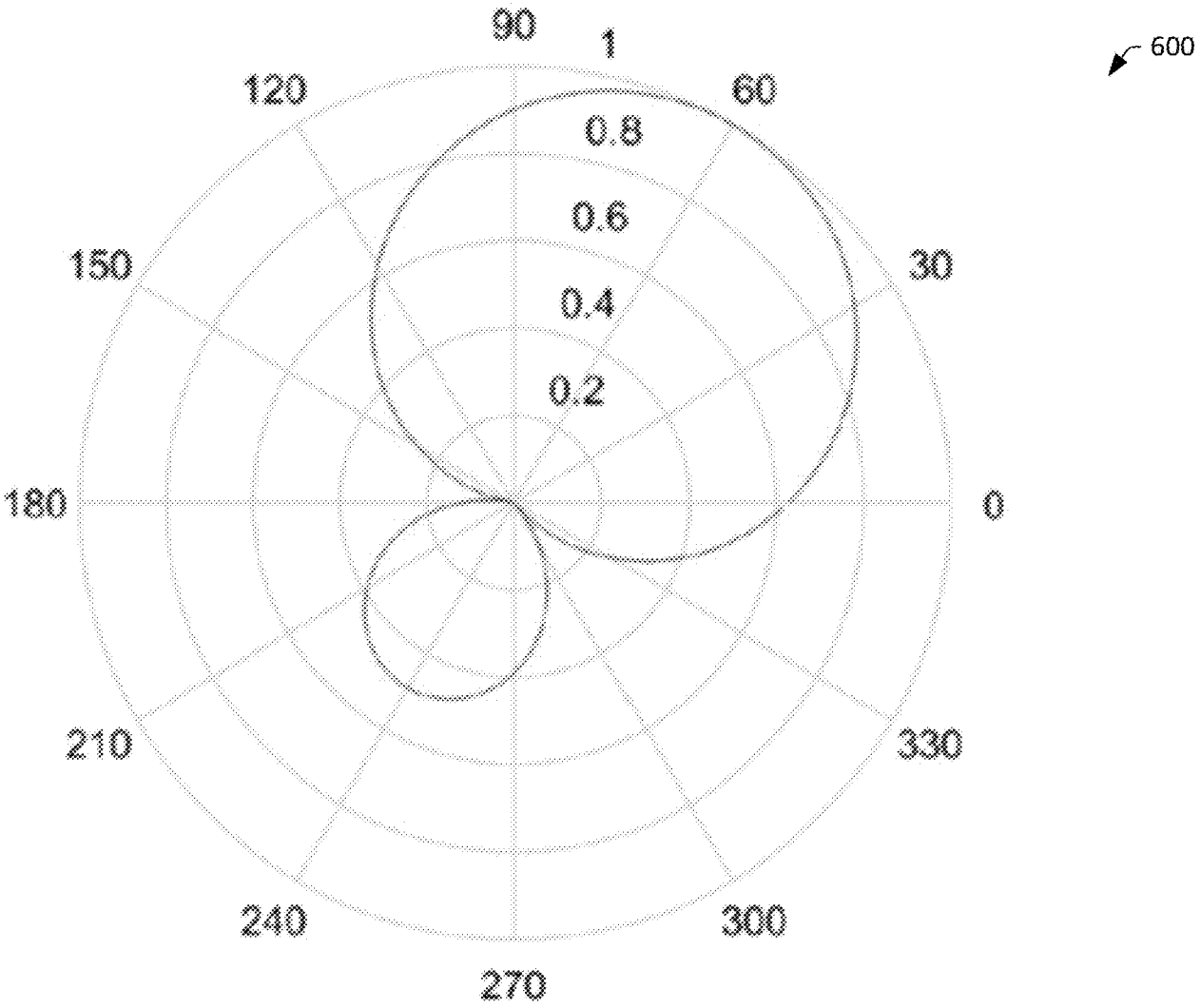
FIG. 6 is a pickup curve of the present disclosure according to the present disclosure.

FIG. 6 shows a sound pickup effect 600 of the technical solutions of the present disclosure in a 60-degree direction under this setting. As can be seen from a comparison with FIG. 1-1, in the technical solutions of the present disclosure, the sound pickup in the 60-degree direction has no attenuation at all. In addition, not only in the 60-degree direction, the technical solutions of the present disclosure can achieve the technical effect of no attenuation in all directions of 360 degrees by dynamically selecting an appropriate $\theta_m$.

In other embodiments, if it is desired to linearly combine signals of the three microphones to form a virtual cardioid microphone, a relationship between $\theta_m$ and $\theta_n$ can be selected as:

$$\theta_n = \theta_m + \pi$$

Through the above algorithm and selecting an appropriate relationship between $\theta_m$ and $\theta_n$, the algorithm and the microphone settings of the present disclosure can realize any type of virtual first-order differential microphones, including a Cardioid microphone, a Subcardioid microphone, a Supercardioid microphone, a Hypercardioid microphone, a Dipole microphone, etc.

On the other hand, the above-mentioned combinations of audio signals are independent of frequency. In other words, the beamforming mode is the same for any frequency. As such, the technical solutions of the present disclosure do not "amplify" the white noise in the low frequency band, and therefore the technical solutions disclosed in the present disclosure can also solve the WNG problem.

Once the beam of the virtual microphone is formed, a beam selection algorithm further compares virtual beams in multiple directions in real time, and selects a beam direction with the highest signal-to-noise ratio (SNR) therefrom as an audio output source.

Figure 7:
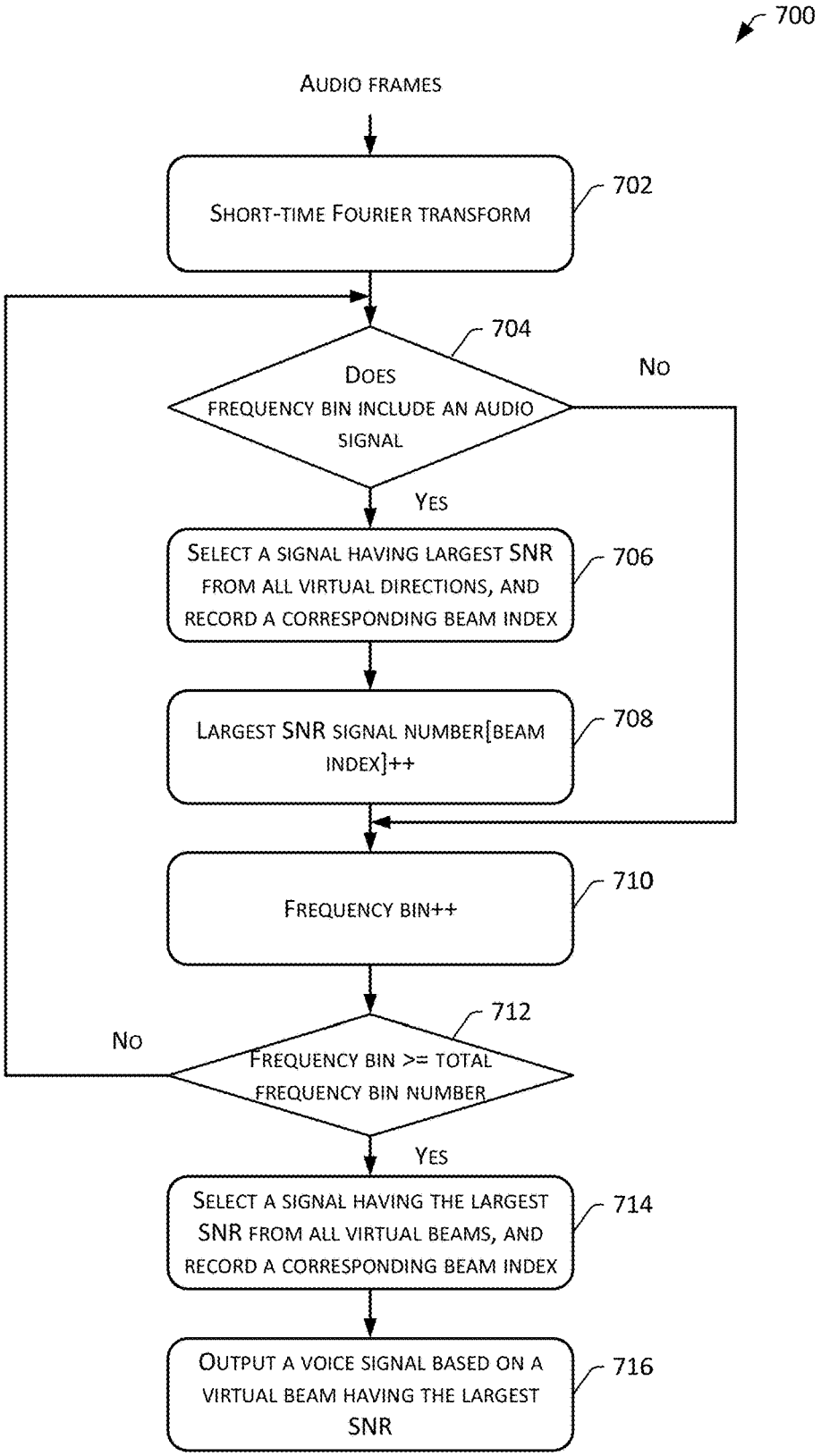
FIG. 7 is a flowchart of exemplary steps of an algorithm according to the present disclosure.

FIG. 7 shows a flowchart of a beam selection algorithm 700 according to the present disclosure. First, at step 702, an audio signal frame is transformed into a frequency domain signal through a Short-Time Fourier Transform.

At step 704, a determination as to whether each frequency bin includes audio signals is performed. If no, the process goes directly to step 710, the frequency bin is incremented. If yes, the process goes to step 706, a signal with the largest signal-to-noise ratio is selected at a current frequency bin, and a corresponding beam index is recorded. Moreover, at step 708 and step 710, the number of signals with the largest signal-to-noise ratio and the frequency bin are separately and sequentially incremented.

At step 712, a determination as to whether all the current frequency bins have been traversed. If not, the above steps 704-710 are repeated. If yes, a signal with the largest signal-to-noise ratio is selected from among all virtual beams at step 714, and the signal with the largest signal-to-noise ratio is output as a voice signal at step 716.

Figure 8:
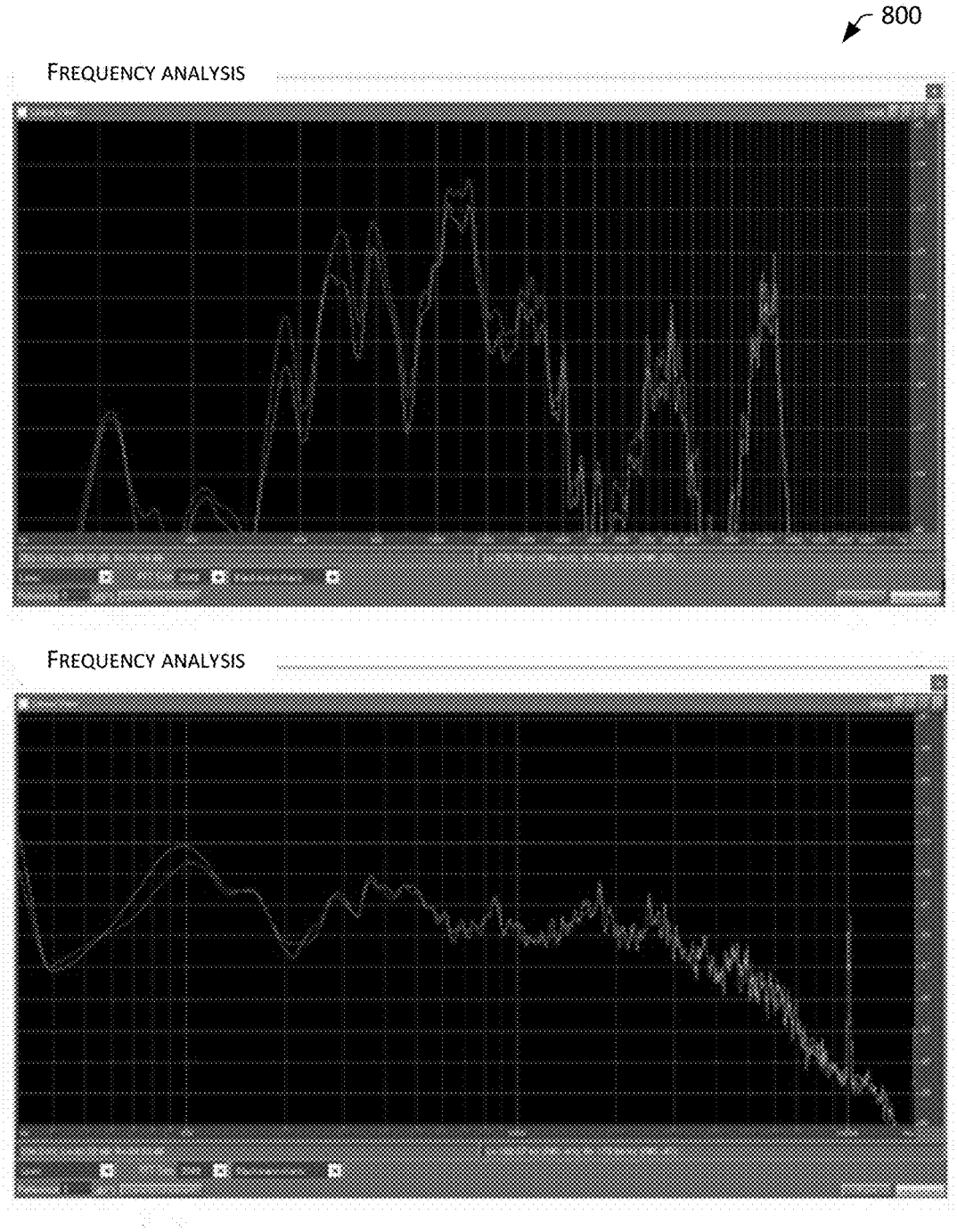
FIG. 8 is an audio signal spectrum obtained according to the present disclosure.

FIG. 8 shows an audio signal spectrum 800 obtained by the technical solutions of the present disclosure, where a red spectrum line is an audio signal obtained by a virtual microphone of the technical solutions of the present disclosure, and a blue spectrum line is an audio signal obtained by a conventional physical microphone. As can be seen, in each spectrum, the SNR of signals obtained by the technical solutions of the present disclosure is better than that of the conventional technologies. On the other hand, the technical solutions of the present disclosure can also solve the WNG problem.

The technical solutions disclosed in the present disclosure have the above-mentioned technical advantages, and thus bring in extensive application advantages. These application advantages include:

(1) Very small size: The size of the smallest cardioid microphone at present can reach 3 mm*1.5 mm (diameter, thickness). Under the combinations of the present disclosure, the total sizes of combinations and settings of microphones, such as those shown in FIGS. 3-5, can be controlled within a range of 5 mm, which enables the use of various types of apparatuses of the present disclosure to obtain volume advantages;

(2) Very high signal-to-noise ratio: As mentioned above, audio apparatuses using the settings and the algorithms of the present disclosure can obtain a signal-to-noise ratio that is much higher than that of the existing technologies;

(3) Large effective sound pickup range and ease of combination: The effective sound pickup range of audio apparatuses using the settings and the algorithms of the present disclosure can be 3× times that of devices of the existing technologies. Therefore, even for a relatively large conference room, an effective sound pickup in the entire area can be achieved by combining only a few audio devices using a Daisy chain method.

In implementations, the microphone settings and the algorithms of the present disclosure are used in a multi-party conference call, so as to solve the problem in which noises (for example, when making a call) are made by other participant(s) in position(s) different from a main speaker when the main speaker is speaking. $\vartheta_m$ can be dynamically configured and selected to align with a direction of the main speaker, and $\vartheta_n$ can be dynamically configured and selected to align with a direction of noise. Therefore, audio signals can be obtained from the direction of the main speaker only, and noises emitted by a noise direction are not picked up by microphones.

In implementations, the microphone settings and the algorithms of the present disclosure are used in voice shopping devices, especially voice shopping devices (such as vending machines) that are situated in public places, so as to solve the problem of being unable to accurately identify audio signals of a shopper in a noisy public place. On the one hand, similar to the above, $\vartheta_m$ is dynamically set and selected in a direction in which a shopper speaks in real time. On the other hand, the technical solutions of the present disclosure have a good suppression effect on background noises, and thereby can accurately pick up voice signals for the shopper.

In implementations, similar to the above description, especially when used in a home environment in which there are noises and other voice signal sources in the surroundings, smart speakers that use the microphone settings and the algorithms of the present disclosure can accurately pick up voice signals of a command sending party while avoiding noises from sources of noises, and further have a good suppression effect on background sounds.

It should be understood that the above description is intended to be exemplary rather than limiting. For example, the foregoing embodiments (and/or their aspects) can be adopted in combination with each other. In addition, a number of modifications may be made without departing from the scope of the exemplary embodiments in order to adapt specific situations or contents to the teachings of the exemplary embodiments. Although the sizes and types of materials described herein are intended to limit the parameters of the exemplary embodiments, the embodiments are by no means limiting, but are exemplary embodiments. After reviewing the above description, many other embodiments will be apparent to one skilled in the art. Therefore, the scope of the exemplary embodiments shall be determined with reference to the appended claims and the full scope of equivalents covered by such claims. In the appended claims, terms "including" and "in which" are used as plain language equivalents of corresponding terms "comprising" and "wherein". In addition, in the appended claims, terms such as "first", "second", "third", etc. are used as labels only, and are not intended to impose numerical requirements on their objects. In addition, the limitations of the appended claims are not written in a means-plus-function format, unless and until such a claim limitation clearly uses a phrase "means for" followed by a functional statement without another structure.

It should also be noted that terms "including", "containing" or any other variants thereof are intended to cover a non-exclusive inclusion, so that a process, method, product or device including a series of elements not only includes those elements, but also includes other elements that are not explicitly listed, or also include elements that are inherent to such process, method, product or device. Without any further limitations, an element defined by a sentence "including a . . . " does not exclude an existence of other identical elements in a process, method, product or device that includes the element.

One skilled in the art should understand that the exemplary embodiments of the present disclosure can be provided as methods, devices, or computer program products. Therefore, the present disclosure may adopt a form of a complete hardware embodiment, a complete software embodiment, or an embodiment of a combination of software and hardware. Moreover, the present disclosure may adopt a form of a computer program product implemented on one or more computer-usable storage media (including but not limited to a magnetic storage device, CD-ROM, an optical storage device, etc.) containing computer-usable program codes.

In implementations, the apparatus (such as the audio signal processing apparatuses as shown in FIGS. 3-5, and the audio signal processing apparatus that is used for implementing the method as shown in FIG. 7) may further include one or more processors, an input/output (I/O) interface, a network interface, and memory. In implementations, the memory may include a form of computer readable media such as a volatile memory, a random access memory (RAM) and/or a non-volatile memory, for example, a read-only memory (ROM) or a flash RAM. The memory is an example of a computer readable media. In implementations, the memory may include program modules/units and program data.

Computer readable media may include a volatile or non-volatile type, a removable or non-removable media, which may achieve storage of information using any method or technology. The information may include a computer-readable instruction, a data structure, a program module or other data. Examples of computer storage media include, but not limited to, phase-change memory (PRAM), static random access memory (SRAM), dynamic random access memory (DRAM), other types of random-access memory (RAM), read-only memory (ROM), electronically erasable programmable read-only memory (EEPROM), quick flash memory or other internal storage technology, compact disk read-only memory (CD-ROM), digital versatile disc (DVD) or other optical storage, magnetic cassette tape, magnetic disk storage or other magnetic storage devices, or any other non-transmission media, which may be used to store information that may be accessed by a computing device. As defined herein, the computer readable media does not include transitory media, such as modulated data signals and carrier waves.

This written description uses examples to disclose the exemplary embodiments, which include the best mode, and also enables any person skilled in the art to practice the exemplary embodiments, including producing and using any devices or systems, and implementing any combined methods. The scope of protection of the exemplary embodiments is defined by the claims, and may include other examples that can be thought by one skilled in the art. If such other examples have structural elements that are not different from the literal language of the claims, or if they include equivalent structural elements that are not substantially different from the literal language of the claims, they are intended to fall within the scope of the claims.

The present disclosure can be further understood using the following clauses.

Clause 1: An audio signal processing apparatus comprising: multiple microphones; and every two of the multiple microphones being arranged in close proximity to each other, and the multiple microphones forming a symmetrical structure.

Clause 2: The apparatus of Clause 1, wherein the multiple microphones are three.

Clause 3: The apparatus of Clause 2, wherein every two of projections of axes of the multiple microphones on a same horizontal plane form an included angle of 120 degrees.

Clause 4: The apparatus of Clause 3, wherein the axes of the multiple microphones are located in a same horizontal plane, and axes of any two of the multiple microphones form an included angle of 120 degrees.

Clause 5: The apparatus of Clause 3, wherein the multiple microphones constitute an overlaid pattern.

Clause 6: The apparatus of Clause 2, wherein every two of axes of the multiple microphones are parallel in pairs, and projection points of the axes in a vertical plane thereof form three vertices of an equilateral triangle.

Clause 7: The apparatus of any one of Clauses 1-6, wherein a distance between ends of any two microphones ranges from 0-5 mm.

Clause 8: The apparatus of Clause 7, wherein the microphones comprises at least one of the following: a Cardioid microphone, a Subcardioid microphone, a Supercardioid microphone, a Hypercardioid microphone, or a Dipole microphone.

Clause 9: An audio signal processing method that uses the apparatus of any one of claims 1-8, the method comprising: performing a linear combination of audio signals obtained by multiple microphones; and dynamically selecting a best pickup direction based on a combined audio signal.

Clause 10: The method of Clause 9, wherein a matrix A used for the linear combination is set as:

$$A = \begin{bmatrix} 1+\cos(\theta_n) & 1+\cos(\theta_n - 2*\pi/3) & 1+\cos(\theta_n + 2*\pi/3) \\ \sin(\theta_m) & \sin(\theta_m - 2*\pi/3) & \sin(\theta_m + 2*\pi/3) \\ (1+\cos(\theta_m))/2 & (1+\cos(\theta_m - 2*\pi/3))/2 & (1+\cos(\theta_m + 2*\pi/3))/2 \end{bmatrix},$$

where $\theta_m$ is a beam angle, and $\theta_n$ is a null angle.

Clause 11: The method of Clause 10, wherein: when the audio signals of the multiple microphones are combined in a virtual Hyper-cardioid microphone mode, $\theta_n=\theta_m+110*\pi/180$.

Clause 12: The method of Clause 10, wherein: when the audio signals of the multiple microphones are combined in a virtual Cardioid microphone mode, $\theta_n=\theta_m+\pi$.

Clause 13: The method of Clause 11 or 12, further comprising: continuously processing the combined audio signal based on a set sampling time interval to obtain audio signals in multiple virtual directions; and comparing the audio signals in the multiple virtual directions, and selecting a direction with a highest signal-to-noise ratio as the pickup direction.

Clause 14: The method of Clause 13, wherein a short-time Fourier transform is used to process the combined audio signal.

Clause 15: The method of Clause 14, wherein the set sampling time interval is 10-20 ms.

Clause 16: The method of Clause 13, further comprising: obtaining and outputting an audio signal based on the selected pickup direction.

Clause 17: A multi-party conference call, comprising the apparatus of any one of Clauses 1-8.

Clause 18: The multi-party conference call of claim 17, wherein the method of any one of Clauses 9-16 is used.

Clause 19: A voice shopping device, comprising the apparatus of any one of Clauses 1-8.

Clause 20: The voice shopping device of claim 19, wherein the method of any one of Clauses 9-16 is used.

Clause 21: A smart speaker, comprising the apparatus of any one of Clauses 1-8.

Clause 22: The smart speaker of claim 21, wherein the method of any one of Clauses 9-16 is used.

Clause 23: An audio signal processing apparatus comprising: a processor; and a non-transitory storage medium, the non-transitory storage medium storing an instruction set, and the instruction set, when executed by a processor, causing the processor to be able to perform the method of any one of Clauses 9-16.

What is claimed is:

1. A method implemented by an apparatus, the method comprising:

performing a linear combination of audio signals obtained by multiple microphones of the apparatus to form a combined audio signal based at least in part on a matrix, matrix elements of the matrix comprising different sine and cosine functions of a beam angle associated with a direction of a desired audio signal and different cosine functions of a null angle associated with a direction of an undesired audio signal; and dynamically selecting a direction with a highest signal-to-noise ratio as a pickup direction based on the combined audio signal.

2. The method of claim 1, wherein the matrix used for the linear combination is set as:

$$A = \begin{bmatrix} 1+\cos(\theta_n) & 1+\cos(\theta_n - 2*\pi/3) & 1+\cos(\theta_n + 2*\pi/3) \\ \sin(\theta_m) & \sin(\theta_m - 2*\pi/3) & \sin(\theta_m + 2*\pi/3) \\ (1+\cos(\theta_m))/2 & (1+\cos(\theta_m - 2*\pi/3))/2 & (1+\cos(\theta_m + 2*\pi/3))/2 \end{bmatrix}$$

where $\theta_m$ is the beam angle, and $\theta_n$ is the null angle.

3. The method of claim 2, wherein: when the audio signals of the multiple microphones are combined in a virtual Hyper-cardioid microphone mode, $\theta_n=\theta_m+110*\pi/180$.

4. The method of claim 2, wherein: when the audio signals of the multiple microphones are combined in a virtual Cardioid microphone mode, $\theta_n=\theta_m+\pi$.

5. The method of claim 1, further comprising:

continuously processing the combined audio signal based on a set sampling time interval to obtain audio signals in multiple virtual directions; and comparing the audio signals in the multiple virtual directions to select the direction with the highest signal-to-noise ratio as the pickup direction.

6. The method of claim 5, wherein a short-time Fourier transform is used to process the combined audio signal.

7. The method of claim 5, wherein the set sampling time interval is 10-20 ms.

8. The method of claim 1, further comprising: obtaining and outputting an audio signal based on the selected pickup direction.

9. One or more computer readable media storing executable instructions that, when executed by one or more processors of an apparatus, causing the one or more processors to perform acts comprising:

performing a linear combination of audio signals obtained by multiple microphones of the apparatus to form a combined audio signal based at least in part on a matrix, matrix elements of the matrix comprising different sine and cosine functions of a beam angle associated with a direction of a desired audio signal and different cosine functions of a null angle associated with a direction of an undesired audio signal; and dynamically selecting a direction with a highest signal-to-noise ratio as a pickup direction based on the combined audio signal.

10. The one or more computer readable media of claim 9, wherein the matrix used for the linear combination is set as:

$$A = \begin{bmatrix} 1+\cos(\theta_n) & 1+\cos(\theta_n - 2*\pi/3) & 1+\cos(\theta_n + 2*\pi/3) \\ \sin(\theta_m) & \sin(\theta_m - 2*\pi/3) & \sin(\theta_m + 2*\pi/3) \\ (1+\cos(\theta_m))/2 & (1+\cos(\theta_m - 2*\pi/3))/2 & (1+\cos(\theta_m + 2*\pi/3))/2 \end{bmatrix}$$

where $\theta_m$ is the beam angle, and $\theta_n$ is the null angle.

11. The one or more computer readable media of claim 10, wherein: when the audio signals of the multiple microphones are combined in a virtual Hyper-cardioid microphone mode, $\theta_n=\theta_m+110*\pi/180$.

12. The one or more computer readable media of claim 9, the acts further comprising:

continuously processing the combined audio signal based on a set sampling time interval to obtain audio signals in multiple virtual directions; and comparing the audio signals in the multiple virtual directions to select the direction with the highest signal-to-noise ratio as the pickup direction.

13. The one or more computer readable media of claim 12, wherein a short-time Fourier transform is used to process the combined audio signal.

14. The one or more computer readable media of claim 12, wherein the set sampling time interval is 10-20 ms.

15. The one or more computer readable media of claim 9, the acts further comprising: obtaining and outputting an audio signal based on the selected pickup direction.

16. An apparatus comprising:

multiple microphones forming a symmetrical structure with every two of the multiple microphones being arranged in close proximity to each other;

one or more processors;

memory storing executable instructions that, when executed by the one or more processors, cause the one or more processors to perform acts comprising:

performing a linear combination of audio signals obtained by the multiple microphones to form a combined audio signal based at least in part on a matrix, matrix elements of the matrix comprising different sine and cosine functions of a beam angle associated with a direction of a desired audio signal and different cosine functions of a null angle associated with a direction of an undesired audio signal; and dynamically selecting a direction with a highest signal-to-noise ratio as a pickup direction based on the combined audio signal.

17. The apparatus of claim 16, wherein the matrix used for the linear combination is set as:

$$A = \begin{bmatrix} 1+\cos(\theta_n) & 1+\cos(\theta_n - 2*\pi/3) & 1+\cos(\theta_n + 2*\pi/3) \\ \sin(\theta_m) & \sin(\theta_m - 2*\pi/3) & \sin(\theta_m + 2*\pi/3) \\ (1+\cos(\theta_m))/2 & (1+\cos(\theta_m - 2*\pi/3))/2 & (1+\cos(\theta_m + 2*\pi/3))/2 \end{bmatrix}$$

where $\theta_m$ is the beam angle, and $\theta_n$ is the null angle.

18. The apparatus of claim 16, the acts further comprising:

continuously processing the combined audio signal based on a set sampling time interval to obtain audio signals in multiple virtual directions; and comparing the audio signals in the multiple virtual directions to select the direction with the highest signal-to-noise ratio as the pickup direction.

19. The apparatus of claim 18, wherein a short-time Fourier transform is used to process the combined audio signal.

20. The apparatus of claim 16, the acts further comprising:

obtaining and outputting an audio signal based on the selected pickup direction.

* * * * *